US005771058A

United States Patent [19]

Kobayashi

[11] Patent Number: 5,771,058

[45] Date of Patent: Jun. 23, 1998

[54] CARD TURNING DEVICE HAVING A ROTARY BODY AND ROLLER UNITS

[75] Inventor: Takehito Kobayashi, Yamanashi-ken, Japan

[73] Assignee: NISCA Corporation, Yamanashi-ken, Japan

[21] Appl. No.: 547,733

[22] Filed: Oct. 26, 1995

[30] Foreign Application Priority Data

Oct. 28, 1994 [JP] Japan ..... 6-289251

[51] Int. Cl.[6] ..... B41J 11/00; B41J 2/325

[52] U.S. Cl. ..... 347/218

[58] Field of Search ..... 347/218, 197, 347/172, 174; 400/120.16, 188, 535, 624, 625; 101/93.43, 232, 453, 487; 399/339, 406, 323, 401, 402; 355/23, 26; 271/297, 305; 235/479, 480

[56] References Cited

U.S. PATENT DOCUMENTS 4,706,563 11/1987 Kazui ..... 101/93.43
4,810,120 3/1989 Narita et al. ..... 400/624
5,600,362 2/1997 Morgaui et al. ..... 347/218
5,636,928 6/1997 Shiina et al. ..... 347/174

OTHER PUBLICATIONS

Japanese Patent Application Publication No. SHO 55–6331 (Jan. 17, 1980) Cited in the specification.
Japanese Patent Application Publication No. SHO 64–90776 (Apr. 7, 1989).
Japanese Patent Application Publication No. HEI 5–108894 (Apr. 30, 1993) Cited in the specification.

*Primary Examiner*—N. Le
*Assistant Examiner*—L. Anderson
*Attorney, Agent, or Firm*—Kane, Dalsimer, Sullivan, Kurucz, Levy, Eisele and Richard, LLP

[57] ABSTRACT

A card turning device turns over a record medium such as an ID card sent out from a thermal printer after printing on one side of the card, so that both sides of the card can be effectively printed by use of the printer having a function of performing one-side printing. By providing a card feed means including card feed rollers in the turning device with a rotation switch means such as a one-way clutch, the card feed rollers are stopped when a rotary body holding the card revolves, so that the card can be turned over without causing displacement of the card.

14 Claims, 10 Drawing Sheets

CARD TURNING DEVICE HAVING A ROTARY BODY AND ROLLER UNITS

BACKGROUND OF THE INVENTION

1. Field of the Invention

This invention relates to a card turning device for use with a card printer, and more particularly, to a device for turning over a record medium such as an identity card to print images and/or patterns on both sides of the record medium with a card printer having a single printing unit capable of printing on one side of the record medium.

2. Description of the Prior Art

There have been widely used compact thermal-transfer printers for printing images such as a full-color photograph and/or patterns such as letters, which indicate identification, reference, proof of membership and so forth, on a record medium such as an identity card (ID card) and credit card.

A thermal wax-transfer printer is usually used for printing two-gradation (black-and-white) images or patterns such as letters, characters and bar codes on the card, and meanwhile, a dye-sublimation printer is sometimes used for printing multiple-color images such as a full-color photograph represented by subtle color gradations with high quality. That is, at least one printing system incorporating both a thermal wax-transfer printing unit and a dye-sublimation printing unit is required for printing such two-gradation images as well as multiple-color images in combination on one side of the card.

Printing of such images and patterns on both sides of the card calls for two sets of the printing units as touched upon above, so as to perform printing on one side of the card with one of the printing units and on the other side of the card with the other printing unit. Naturally, the card printer comprising two sets of the thermal wax-transfer printing unit and the dye-sublimation printing unit, and means for respectively driving these printing units becomes large in size and weight and complicated, thus increasing the cost of production.

As one possible way for overcoming the drawbacks of the conventional card printer capable of printing both sides of the card, attempts are now being made to provide a card turning device. To be specific, the double-side printing on the card may possibly be performed by turning over the card so as to perform printing on the both sides of the card, using a printing system that enables printing on one side of the card. For instance, a sheet-turning device provided in a double-side copying machine is applicable to a one-side printing system. As one prior art, there is disclosed a turning device for a copying machine in Japanese Patent Application Public Disclosure No. SHO 55(1980)-6331(A).

The prior art turning device for the copying machine has a rotary body or drum with two pair of rollers. A copying paper is turned upside down by rotating the rotary body while being held between the paired rollers so as to copy an image on the reverse side of the copying paper.

A similar turning device for a card printer is disclosed in Japanese Patent Application Disclosure No. HEI 5(1993)-108894(A). This conventional turning device comprises a rotary body having two pair of card feed rollers for moving a card along a card feed passage, a card feeding unit for driving the rollers, and a turning unit for revolving the rotary body.

The operating principle of the aforenoted turning device will be explained with reference to FIG. 1(A) and FIG. 1(B).

As illustrated, in the turning device 1, the rotary body 2 rotatable on its rotational axis A and provided with the paired rollers 2*a* and 2*b* arranged on the card feed passage W passing through the axis A. The rotary body 2 is driven to rotate by a turnover motor 3, and the rollers 2*a* and/or 2*b* are driven to rotate by transmitting rotation of a card feeding motor 4*a* thereto through a belt 4*b*, axial pulley 4*c*, and belt 4*d*, so as to move the card C back and forth along the card feed passage W.

First, the card C having one side (face So) printed in a printing section PRT is sent from the printing section PRT to the card turning device 1, and held in position between the respective paired rollers 2*a* and 2*b*, as shown in FIG. 1(A). Then, the card c1 held between the paired rollers 2*a* and 2*b* is turned over by driving the turnover motor 3 while halting the rotation of the rollers 2*a* and 2*b*, so that the inverted card c1 is sent back to the printing section PRT for the purpose of printing on the reverse side (face Sr) of the card.

However, when the rotary body 2 is rotated 180° as the card feeding motor 4*a* is kept stopping, the roller (2*a* in FIG. l(B)) connected with the axial pulley 4*c* being stopped rotates relatively by δ (half circumference of the pulley 4*c*). As a result, the roller 2*a* rotates equivalently, resulting in displacing the card C by the length Δ (=δ) from the proper position c1.

The displacement of the card C entails a disadvantage such that the card comes off or falls from the paired rollers 2*a* and/or 2*b*, or conceivably makes it impossible to rotate the rotary body 2.

Thus, the displacement Δ from C to c1 must be corrected before the card is sent back to the printing section PRT. For correcting the displacement of the card, an especially highly skilled controlling system capable of detecting the position of the card and calculating and adjusting the displacement Δ to a high degree is required. Since such a controlling system turns out to be too complicated in structure and operation and expensive, it has been so far considered that a printer provided with two one-side printing units is desirable from the standpoint such as of actual application, rather than the supplementary installation of the turning device as specified above.

OBJECT OF THE INVENTION

An object of this invention is to provide a card turning device capable of turning over a card sent out from a card printer having a single one-side printing unit, and sending back the inverted card to the card printer, so as to performing printing on both sides of the card with high efficiency.

Another object of this invention is to provide a card turning device capable of turning over a card fed from a card printer without causing displacement of the card, and holding the inverted card in position when sending back the card to the printer with high accuracy.

Still another object of this invention is to provide a simple card turning device applicable to various types of card printers and any other card handling machines, which can be controlled with ease and make the card printer compact and at a low cost.

SUMMARY OF THE INVENTION

To attain the objects described above according to this invention, there is provided a card turning device for a card printer, which comprises a rotary body including roller units with paired card feed rollers, a card feed means including a card feeding motor and a pulley freely disposed on the rotational axis of the rotary body for transmitting rotational motion of the card feeding motor to the card feed rollers to move a card held between the card feed rollers, means for turning the rotary body, and a rotation switch means for selectively transmitting the rotation of the card feeding motor to at least one of the card feed rollers.

The rotation switch means may be a one-way clutch for transmitting the rotational motion in one direction from the card feeding motor to at least one of the card feed rollers, or an electromagnetic clutch.

The card with one side printed by the card printer is sent out from the card printer and introduced into the card turning device united with the card printer along a card feed passage by driving the card feed means. The card fed into the card turning device is retained in position between the paired card feed rollers. In the state that the card held by the paired card feed rollers and the card feed means is stopped, the rotary body is rotated 180° to turn the card upside down.

When the rotary body revolves, the rotation switch means is brought into a disengaged state to prevent the card feed rollers from rotating. Consequently, the card held by the card feed rollers is turned over without change its position. Then, the inverted card is send back to the card printer by driving the card feed means so as to performing printing on the other side of the card.

Since the position of the card held by the card feed rollers is not changed even when the rotary body revolves, troublesome position controlling or correcting measures are unnecessary, and the card can be exactly moved back and forth between the card turning device and the printer.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

The present invention will become more fully understood from the detailed description given hereinbelow and the accompanying drawings which are given by way of illustration only, and thus are not limitative of the present invention.

The card turning device according to this invention is applicable to a card printer that enables printing on one side of a card, so that the card with one side printed is turned over to perform printing on the other side of the card.

Figure 2:
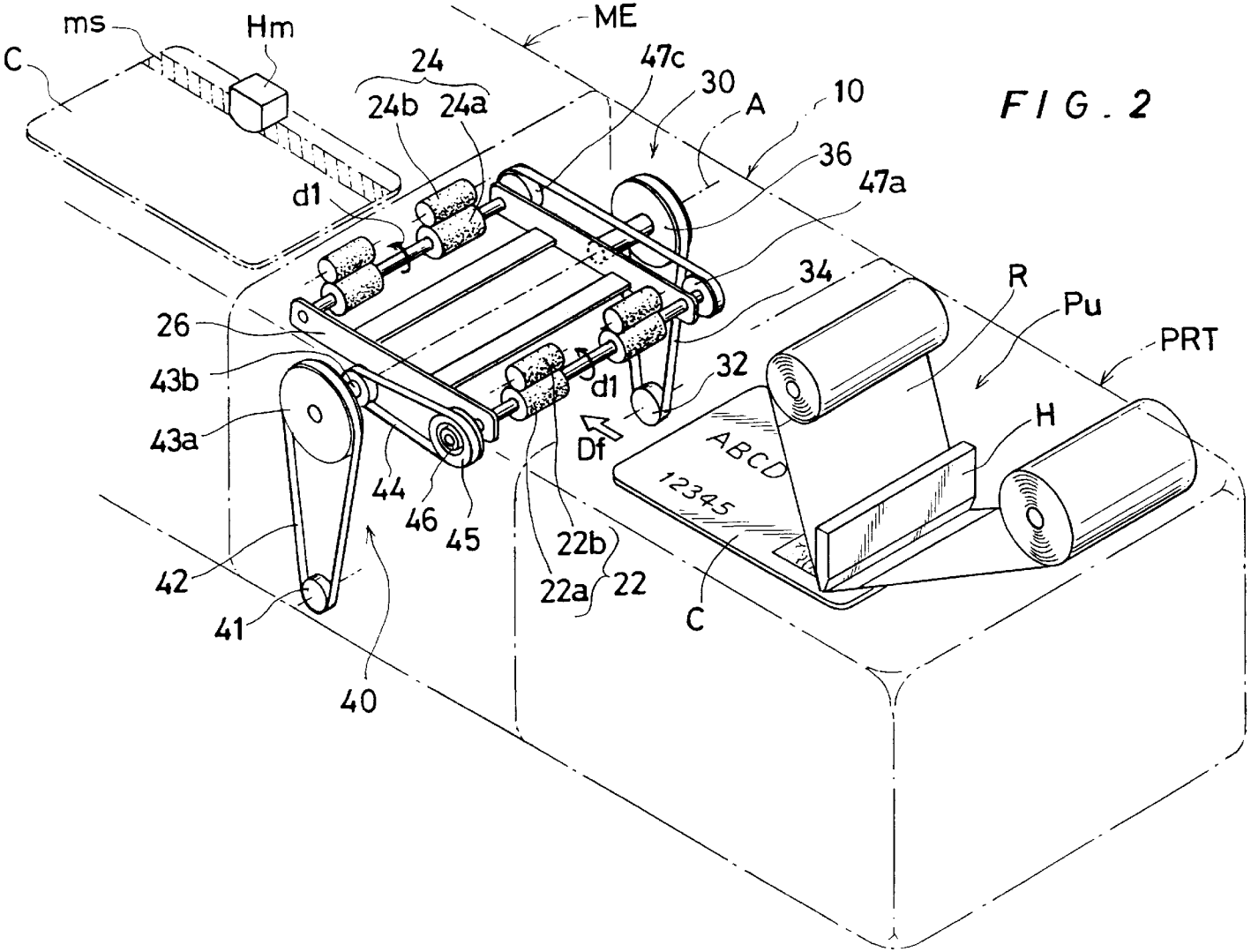
FIG. 2 is a schematic perspective view showing a card turning device according to this invention, which is united with a card printer.
Figure 3:
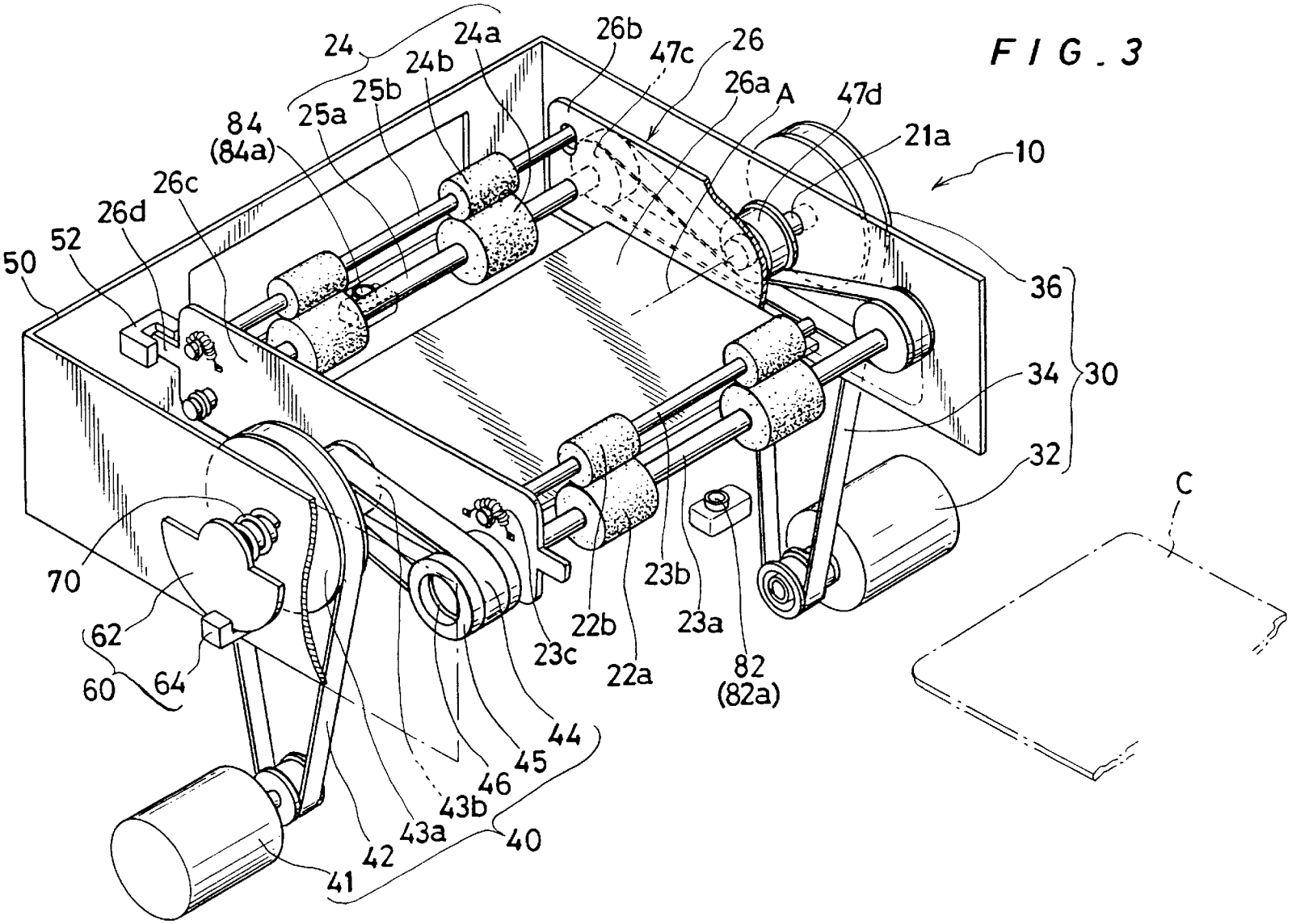
FIG. 3 is a schematic perspective view showing one embodiment of the card turning device of this invention.
Figure 4:
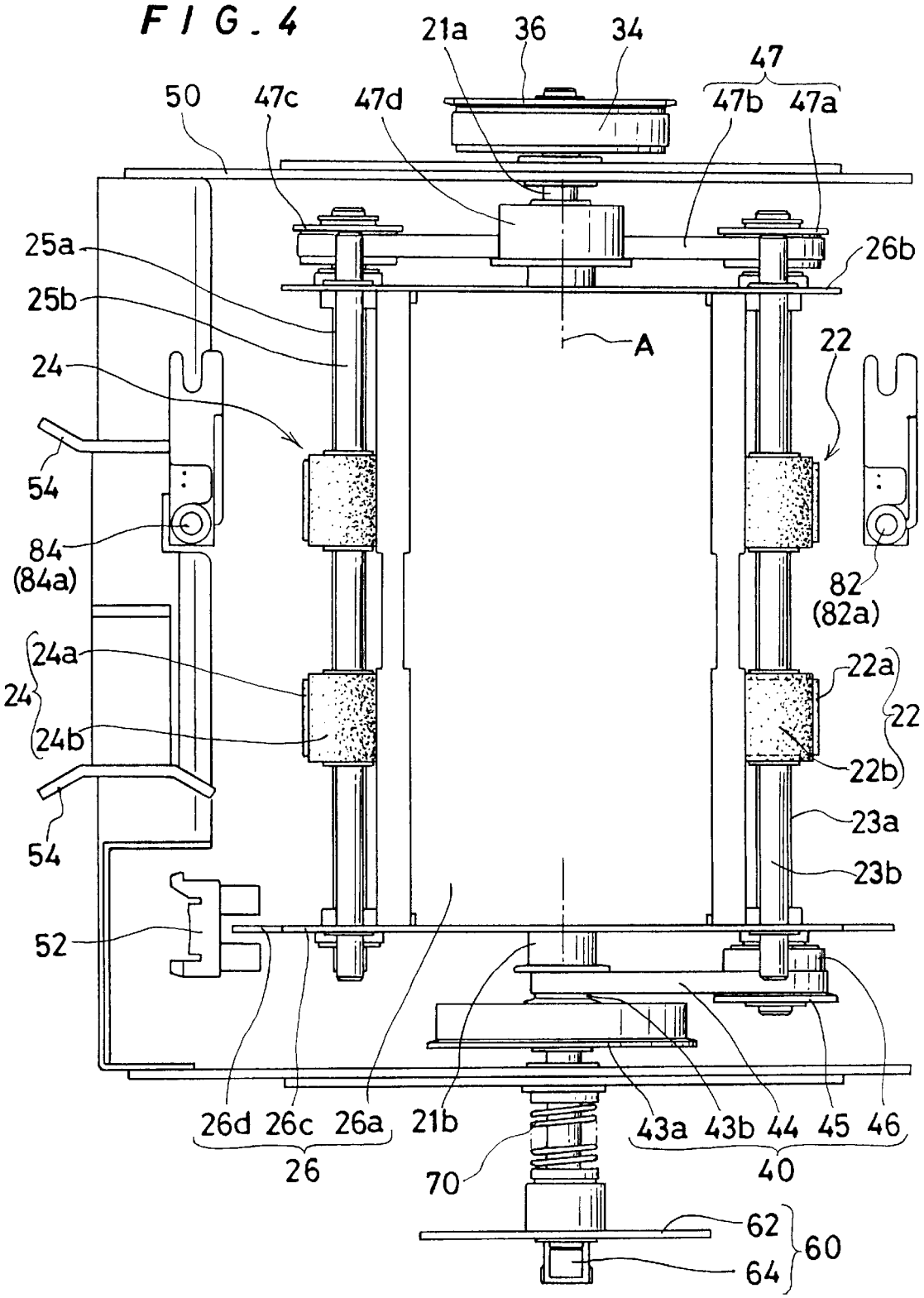
FIG. 4 is a plan view of the device of FIG. 3.
Figure 5:
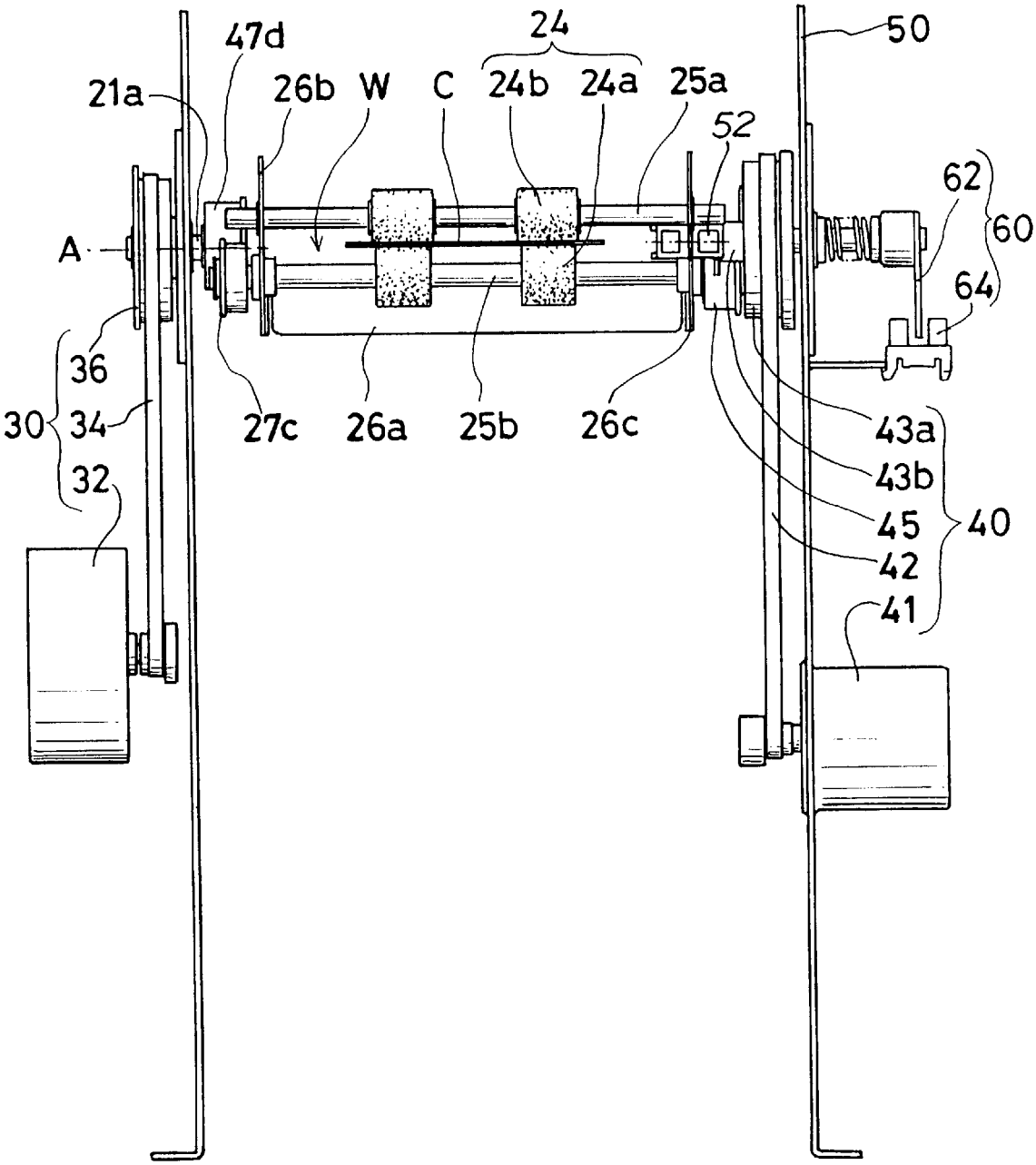
FIG. 5 is a left side view of the device of FIG. 3.
Figure 6:
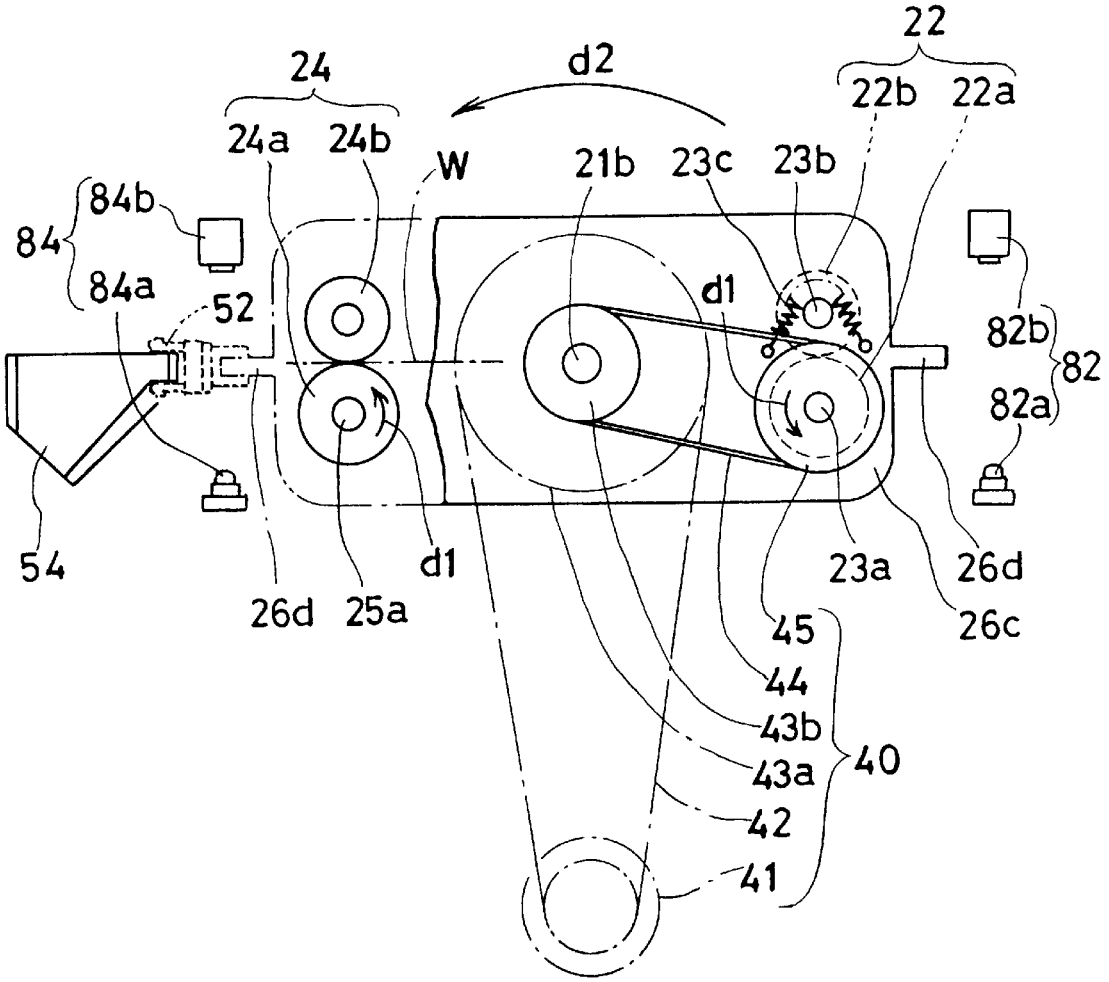
FIG. 6 is a front view showing the principal portion of the device of FIG. 3.

As schematically illustrated in FIG. 2, the card printer to which the card turning device 10 is united has a printing unit Pu for thermally transferring one or more kinds of thermal inks of a thermal wax-transfer type and/or dye-sublimation type, which are applied to an ink ribbon base R, to the card C by selectively driving a thermal head H. The printing unit Pu fundamentally serves to print images and/or patterns on one side (upper surface in FIG. 2) of the card C, but does not possess a function of printing on the other side (lower surface) of the card. So, the card turning device 10 according to this invention is attached to the card discharge side of the card printer PRT, so that the card issued from the card printer PRT is turned upside down and sent back to the card printer PRT to perform printing on the aforesaid other side. Thus, the both sides of the card can be printed with a single printing unit Pu capable of performing one side printing.

In FIG. 2, only one set of printing unit Pu is illustrated by way of example in the card printer. However, in a case of performing multiple printings on one side of the card by use of a thermal wax-transfer ink ribbon and a dye-sublimation ink ribbon, two or more printing units respectively incorporating the different types of ink ribbons may be juxtaposed along the card feed passage W. It is needless to say that, even when the printer has a plurality of printing units, a function of printing on only one side of the card suffices for the card printer PRT as long as the card turning device of this invention is used.

In addition, the printing system including the printing unit and card turning device may be fitted with a magnetic encoder ME having a magnetic head Hm for magnetically writing information data to a magnetic stripe ms on the card C such as a common credit card. However, this magnetic encoder should not be understood as limitative in this invention.

The first embodiment of this invention will be described hereinafter in more detail with reference to FIG. 2 through FIG. 6.

The card turning device 10 according to this invention comprises a rotary body 20 rotatable on its own axis (turning axis A), which is provided with roller units 22 and 24, a turning means 30 for rotating the rotary body 20 about the axis A, and card feed means 40 for driving at least one of the roller units 22 and 24.

The rotary body 20 has axial rotation shafts 21*a* and 21*b* supported rotatably on a support base 50 so as to be rotated on the axis A by driving the turning means 30.

The rotary body 20 is formed substantially of a frame 26 constituted by a horizontal beam 26*a* provided at its both side ends with side walls 26*b* and 26*c* between which the aforesaid roller units 22 and 24 are retained.

The turning device has a position sensor 52 for detecting the position of the rotary body 20, which is constituted by a photo interrupter generally formed of a light-emitting element and a photo-detector for detecting marking tags 26*d* protruding horizontally from both ends of the side wall 26*c*. With the position sensor 52, the prescribed horizontal posture of the rotary body 20 can be discerned.

The roller units 22 and 24 are supported by the frame 26 and symmetric with respect to the turning axis A. The roller units 22 and 24 respectively have paired rollers 22*a*–22*b* and 24*a*–24*b* which come in contact with each other in pairs on the card feed passage W passing through the axis A. The paired rollers 22*a*, 22*b*, 24*a* and 24*b* are retained by rotation shafts 23*a*, 23*b*, 25*a* and 25*b*, respectively. Although the rotation shafts each have two rollers in the illustrated embodiment, the number of such rollers per shaft is by no means limitative. One or more rollers may be disposed on one shaft.

The rollers 22*a* and 24*a* of the aforenoted paired rollers are drive rollers integrally rotatable with the driving rotation shafts 23*a* and 24*a*. The rollers 22*b* and 24*b* are idle rollers freely rotatable, but urged toward the rollers 22*a* and 24*a* by spring means 23*c* so as to bring the idle rollers 22*b* and 24*b* into press contact with the driving rollers 22*a* and 24*a*, respectively. Thus, the idle rollers 22*b* and 24*b* rotate together with the driving rollers 22*a* and 24*a*, thereby moving the card C held therebetween.

The turning means 30 for turning the rotary body 20 around the turning axis A comprises a turnover motor 32, a transmission means 34, and a turnover pulley 36 secured on the shaft 21*a* and connected to the turnover motor 32 via the transmission means 34.

The turnover motor 32 may be of any type insofar as it can produce rotation in at least one direction and be precisely controlled in its rotational angle. Although a pulse motor can be preferably used, a combination of a DC motor and a rotation controller may be applied instead.

In the illustrated embodiment, as the transmission means 34, an endless belt is used, but may of course be any mechanism such as a gear system and a crank.

The card feed means 40 for driving the roller unit 22 in this embodiment comprises a card feeding motor 41, a stationary-side transmission means 42, axial pulleys 43*a* and 43*b*, a turning-side transmission means 44, a feeding pulley 45 secured on at least one of the shafts, 23*a*, and a rotation switch means 46 for allowing rotation in one direction from the card feeding motor 41 to be transmitted to the aforenoted shaft 23*a*.

Similarly to the turnover motor 32, the card feeding motor 41 may be of any type insofar as it can rotate the rollers 22*a* and 24*a* in one direction (card feeding direction d1 in which the card is forwarded) and be precisely controlled in its rotational angle. As the card feeding motor 41, a pulse motor or a combination of a DC motor and a rotation controller may be used.

In this embodiment, the transmission means 42 and 44 are endless belts, whereas they may be any mechanism such as a gear system and a crank.

The axial pulleys 43*a*, 43*b* are rotatable independent of the shaft 21*b* connected to the side wall 26*b*. The pulleys 43*a* and 43*b* in this embodiment are formed in substantially one body and have different diameters, but they may of course be equal in diameter.

The rotation switch means 46 in this embodiment is a one-way clutch and assembled in the feeding pulley 45. That is, the one-way clutch 46 may have an outer ring holding the transmission means (belt) 44 and an inner ring fixed on the shaft 23*a*.

Accordingly, when the card feeding motor 41 is driven to rotate the pulleys 43*a* and 43*b* in the card feeding direction d1, the rollers 22*a* and 24*a* rotate in the same direction, thus forwarding the card C as shown in FIG. 2. However, if the motor 41 is reversed to rotate in the opposite direction to d1, the rollers 22*a* and 24*a* do not rotate because the one-way clutch 46 incorporated in the feeding pulley 45 is brought into a disengaged state when the feeding pulley 45 rotates in the opposite direction to the direction d1.

The rotational motion produced by the card feeding motor 41, which is transmitted to the shaft 23*a* via the transmission means 42, feeding pulleys 43*a* and 43*b*, transmission means 44 and pulley 45, is further transmitted from the shaft 23*a* to the shaft 25*a* via a rotation transmission system 47 including a pulley 47*a* attached to the shaft 25*a*, a belt 47*b* and a pulley 47*c*. An element 47*d* is a tension roller 47*b* for exerting tension to the belt 47*b*, but this roller is not absolutely necessary to this invention.

On the axial shaft 21*b* extending laterally from the side wall 26*b* of the frame 26, there is mounted a card face detector 60 for perceiving the surface of the card C, which is generally formed of a semicircular index plate 62 attached to the shaft 21*b* and an index sensor 64 such as a photo interrupter fixed on the support base 50.

A spring 70 disposed between the index plate 62 and the support base 50 serves to impart a thrust force to the frame 26, so as to prevent wobbling of the frame 26.

Next, the operation of the card turning device 10 of this invention will be explained below, particularly referring to FIG. 2 and FIGS. 7A to 7C, to reveal the effect of preventing displacement of the card when turning over the card.

As shown in FIG. 2, when the card C is fed in the direction Df from the printer PRT upon completion of printing on one side of the card, the card feeding motor 41 starts to rotate the pulleys 43*a*, 43*b* and 45 in the card feeding direction d1. At this time, the one-way clutch (rotation switch means) 46 assumes its engaged state to permit the rotational motion produced by the motor 41 to be transmitted to the shaft 23*a*, consequently to rotate the rollers 22*a* and 22*b* in the card feeding direction d1. The rotational motion is further transmitted to the shaft 25*a* through the rotation transmission system 47, thus simultaneously rotating the rollers 24*a* and 24*b* in the card feeding direction.

Figure 1:
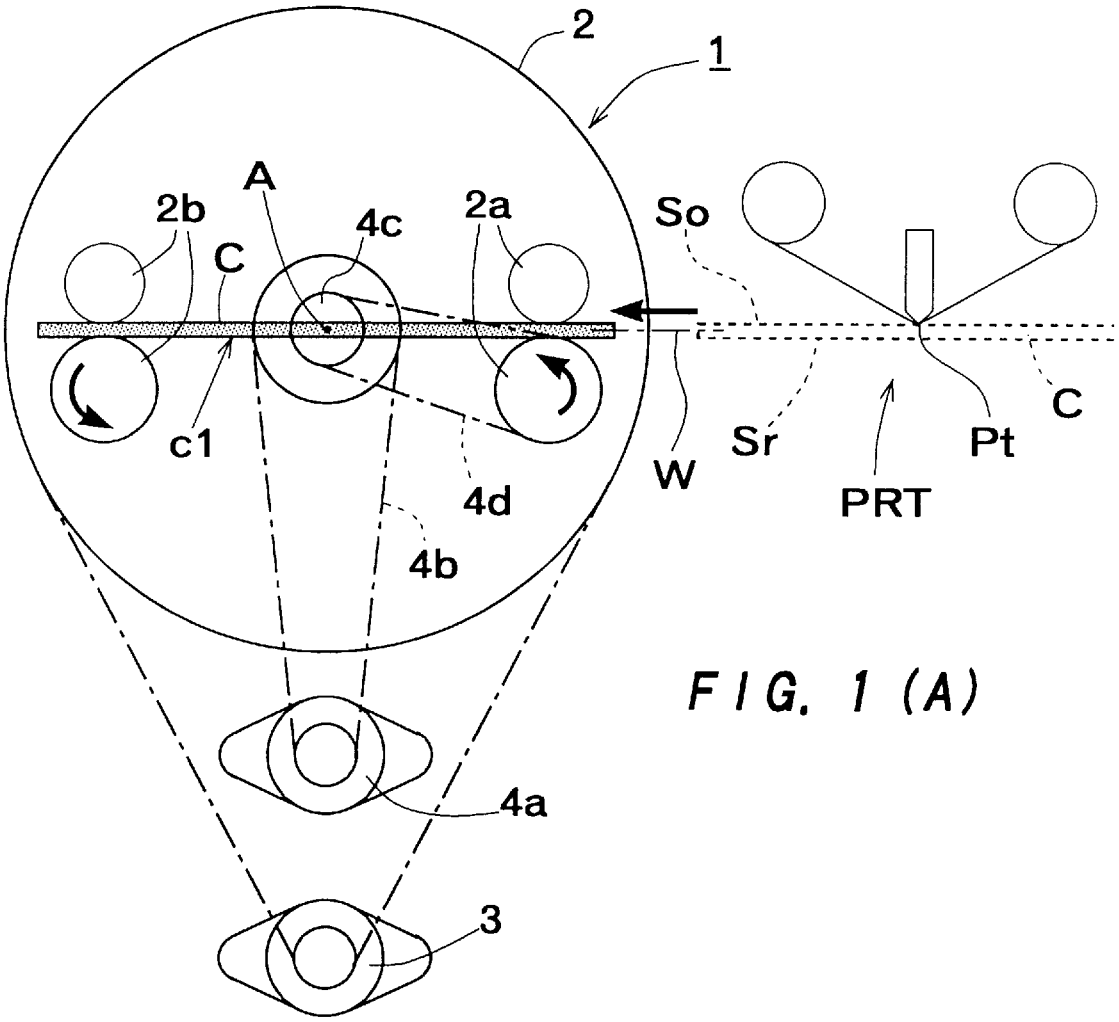
FIGS. 1(A) and 1(B) are conceptual diagrams explanatory of a phenomenon in which displacement of a card is caused when the card is turned over with a common card turning device.
Figure 1:
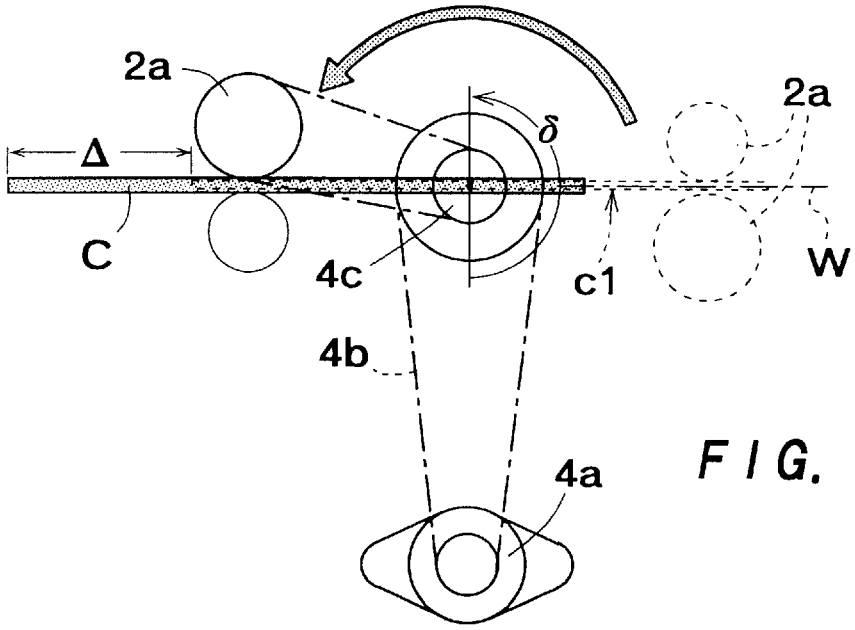
Figure 7A:
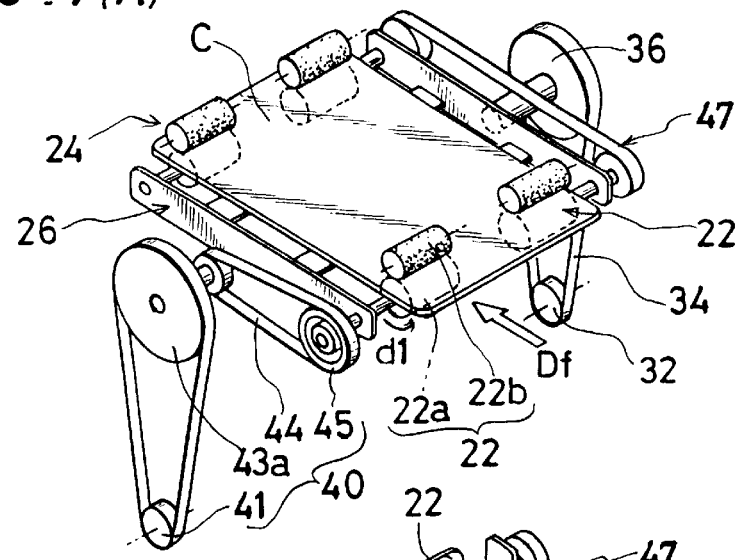
FIG. 7(A) through FIG. 7(C) are perspective views showing the operating principle of the device of this invention.

When the card C from the printer PRT is fed into between the rotating rollers 22*a* and 22*b*, it is forwarded by the rollers 22*a* and 22*b* as shown in FIG. 7(A), and then, when the card C reaches the prescribed turning position defined at the substantial center of the frame 26, which corresponds to the position c1 as depicted in FIG. 1(A), the card feeding motor 41 is stopped to bring the card C to a standstill there.

Figure 7B:
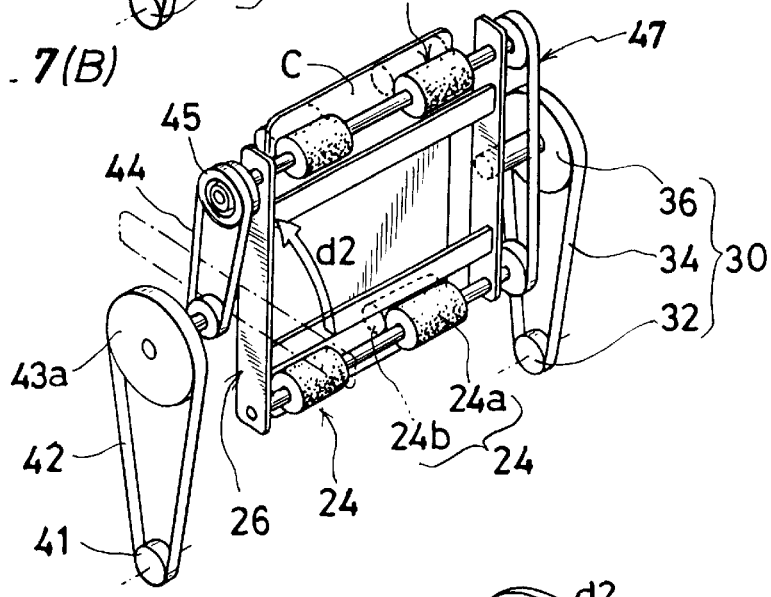

Next, the turnover motor 32 is driven to rotate the turnover pulley 36 in the turning direction d2 same as the direction d1 as shown in FIG. 7(B). Since the pulleys 43*a* and 43*b* are stopped at this time, the belt 44 wound round the pulley 43*b* moves by a circumferential length (δ in FIG. 1(B)) of the pulley 43*b* corresponding to the angle at which the rotary body 20 revolves. As a result, the feeding pulley 45 rotates relative to the rotary body 20 in the opposite direction to the feeding direction d1.

If the feeding pulley 45 is connected with the shaft 23*a* at this time, the rollers 22*a* and 24*a* should rotate in the opposite direction to the direction d1, as the result which the card C is displaced by the length equal to the circumferential length δ of the pulley 43*b* as shown in FIG. 1(B). However, since the one-way clutch 46 in the feeding pulley 45 is brought into a disengaged state when the feeding pulley 45 rotates in the opposite direction to the card feeding direction d1 as touched upon above, the shaft 23*a* does not rotate, so that the card C does not move relative to the rotary body 20.

Figure 7C:
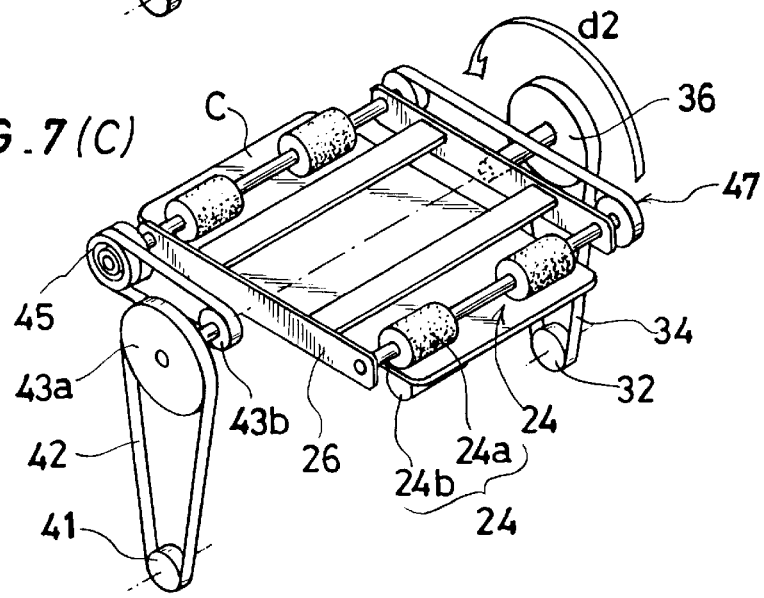

Thus, the card C is turned over 180° without moving relative to the rotary body 20 as shown in FIG. 7(C). Therefore, the card C does not come off or fall from the prescribed turning position in the rotary body 20.

The one-way clutch having the outer and inner rings between which needle rollers are interposed is used as the rotation switch means 46 in the foregoing embodiment, whereas this invention does not contemplate imposing any limitation on the structure of the rotation switch means. To be more specific, an electromagnetic clutch may be assembled in the card turning device of the present invention as the rotation switch means as shown in FIG. 8.

Figure 8:
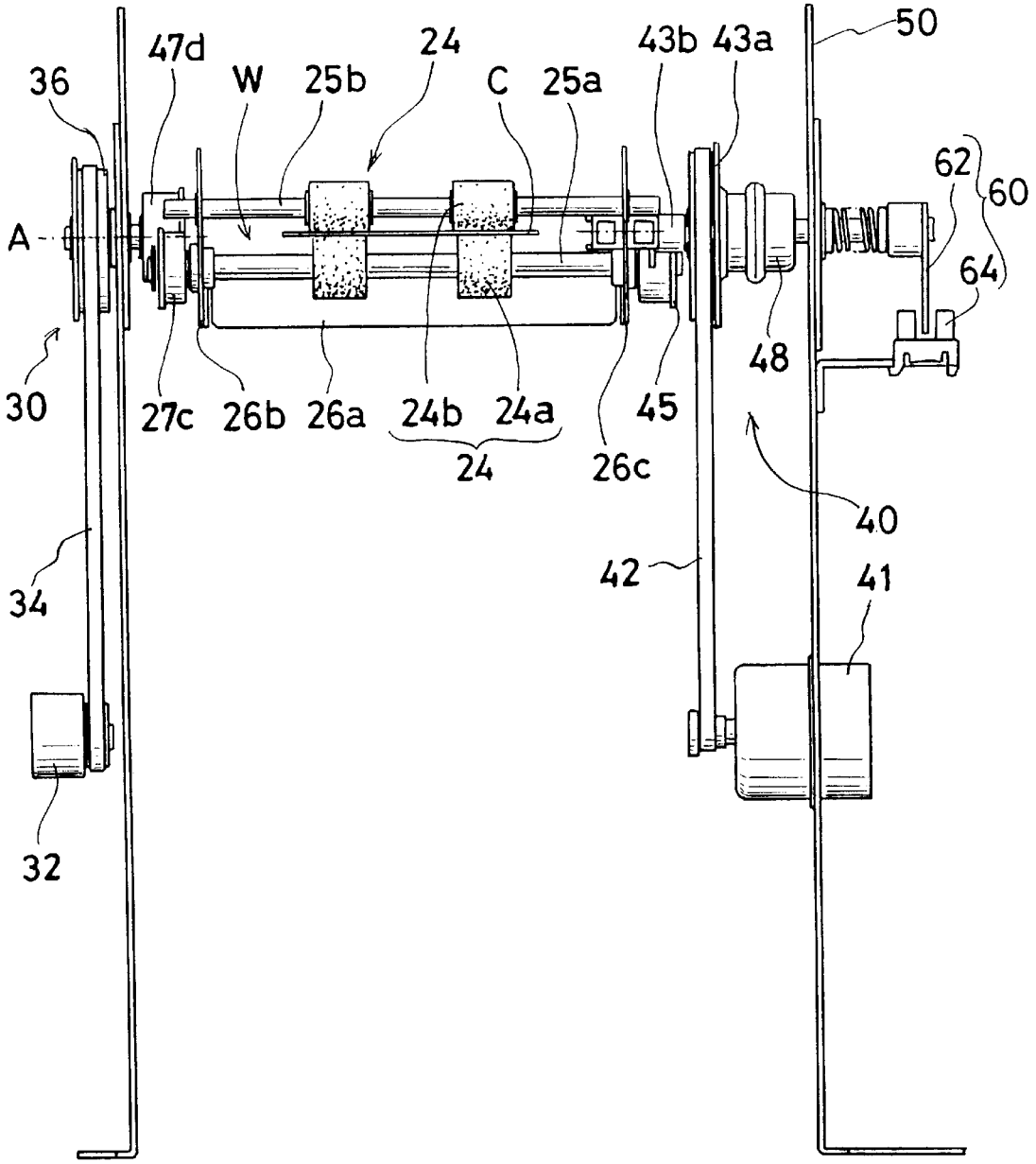
FIG. 8 is a left side view showing a second embodiment of this invention.

The electromagnetic clutch 48 in the second embodiment of FIG. 8 is united with the feeding pulley 43*a*, but may be practically disposed anywhere on the rotation transmission route from the card feeding motor 41 to the shaft 23*a*.

With the electromagnetic clutch 48 disposed on the rotation transmission route, the desired controlling of the rotational direction of the rotary body 20 can easily be carried out, so that the rollers 22*a* and 24*a* do not rotate when the rotary body 20 revolves on the axis A.

According to this embodiment, there is no need for determination of the direction of rotation of the rotary body and the card feeding rollers 22*a* and 24*a*.

In the second embodiment of FIG. 8, the elements indicated by like reference numerals with respect to those of the first embodiment have analogous structures and functions to those of the first embodiment and will not be described in detail again.

Figure 9:
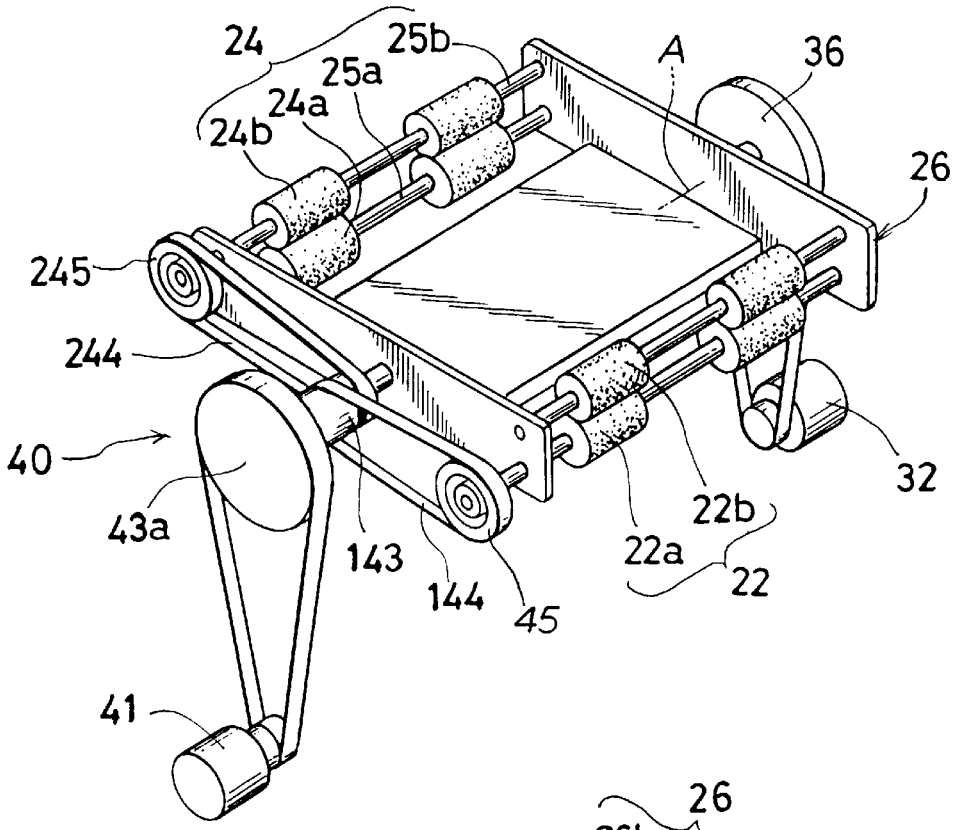
FIG. 9 is a perspective view schematically showing a third embodiment of this invention.

In the first and second embodiments mentioned above, the rotational motion is given to the rotation shaft 25*a* through the rotation transmission system 47 including the pulley 47*a*, belt 47*b* and pulley 47*c*, whereas the rotation shaft 25*a* may be driven directly by an axial pulley 143 (equivalent to the pulley 43*b* in the aforementioned embodiments) united with the axial pulley 43*a* as shown in FIG. 9.

That is to say, the axial pulley 143 is connected with the feeding pulley 45 through the belt 144 and a feeding pulley 245 fixed on one end of the shaft 25*a* through a belt 244. Of course, the pulley 245 has a one-way clutch same as that assembled in the pulley 45 in the first embodiment.

With this structure, the rollers 22*a*, 22*b*, 24*a* and 24*b* can be effectively driven to move the card in the feeding direction similarly to the foregoing embodiments.

Also in this third embodiment, the reference numerals which have equivalents in the diagrams of the foregoing embodiments denote identical or equal component elements. Further, in this embodiment, the belts 144 and 244 are used as constituents in the rotation transmission means, whereas they may be replaced by any other mechanism such as a gear system and a crank.

Figure 10:
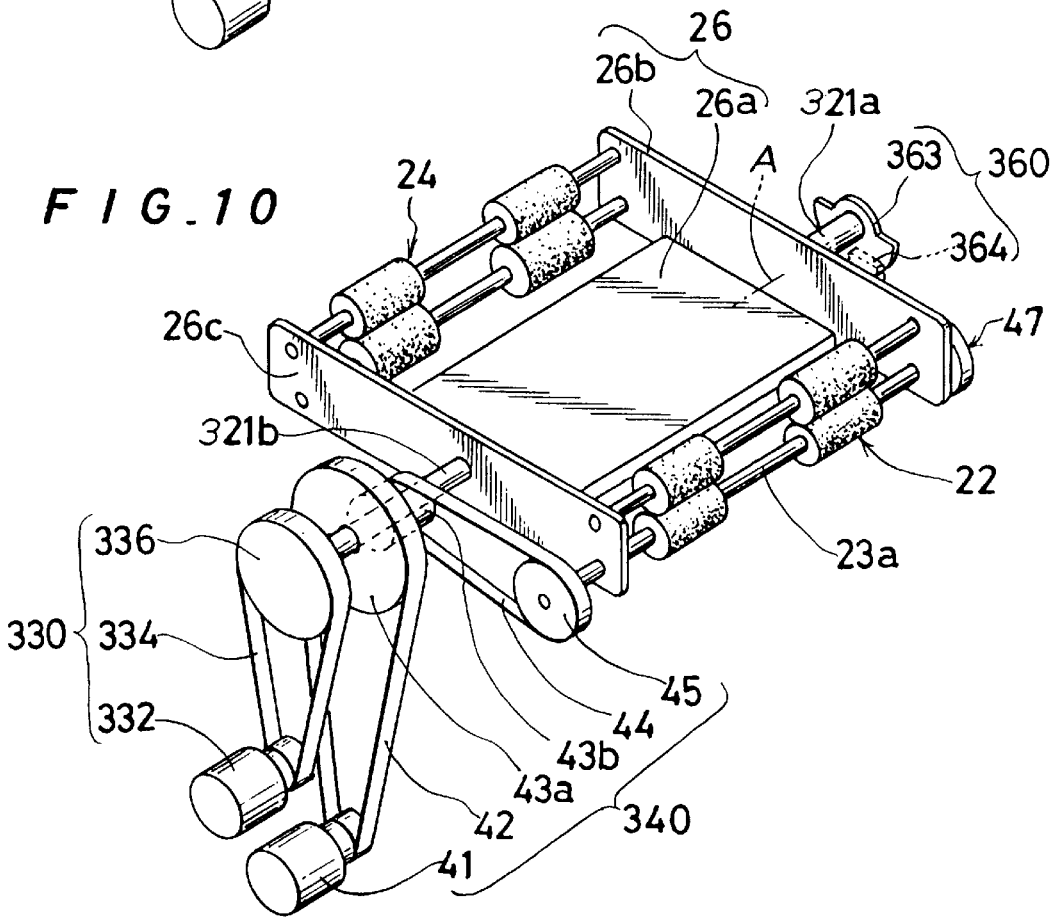
FIG. 10 is a perspective view schematically showing a fourth embodiment of this invention.

In the fourth embodiment shown in FIG. 10, on one side of the rotary body 20, there are juxtaposed card turning means 330 (corresponding to the element 30 in the foregoing embodiments) for turning the rotary body 20 and a card feed means 340 (corresponding to the element 40 in the foregoing embodiments) for driving the rollers 22*a*, 22*b*, 24*a* and 24*b*.

In this fourth embodiment, a card face detector 360 (corresponding to the element 60 in the aforementioned embodiments) is disposed on one of rotation shafts, 321*a*.

The card turning means 330 comprises a turnover motor 332, a transmission means (belt) 334, and a turnover pulley 336. The turnover pulley 336 is connected to the other rotation shaft 321*b* for rotating the rotary body 20 on the axis A.

The card feed means 340 has axial pulleys 43*a* and 43*b* is supported by rotation shaft 32*lb*, but freely rotatable relative to the rotation shaft 321*b* as illustrated.

The elements denoted by like numerals fulfill like functions in the foregoing embodiments.

Thus, the embodiment of FIG. 10 shows a hint as to a possibility that the card turning device according to this invention can be applied to every card printer and cope with all situations in use.

As one example of the application, the card turning device of this invention can be used as a card segregating device for removing defective cards.

Figure 11:
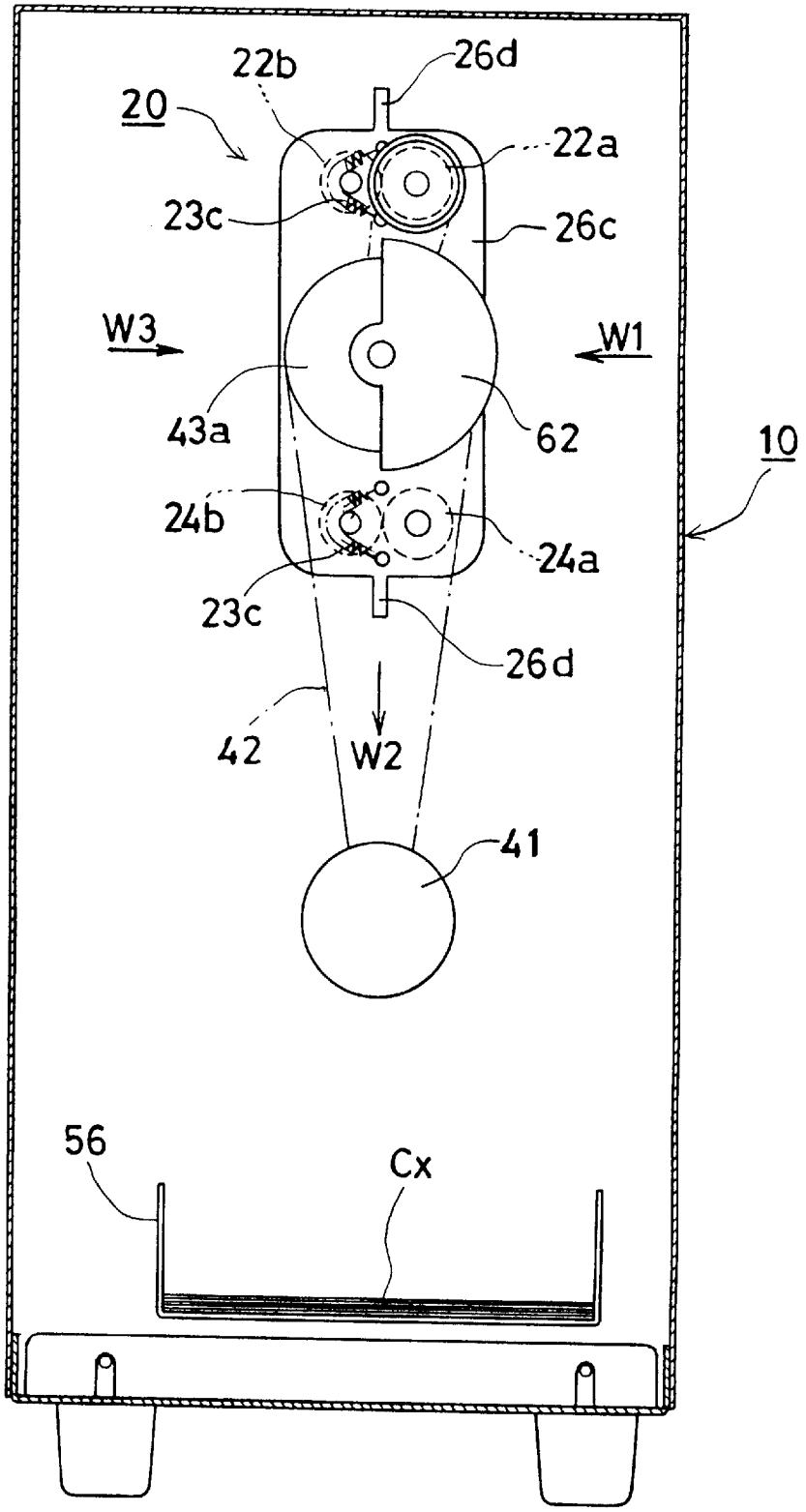
FIG. 11 is an explanatory diagram schematically showing the card turning device used as a card segregating device according to this invention.

As illustrated in FIG. 11, the card segregating device can be formed without modifying the card turning device of this invention.

When the card to be handled by the card turning device 10 used as the card segregating device is conformed, the rotary body 20 assumes its horizontal posture as shown in FIG. 2. That is, when the conforming card is fed in the direction W1 from a printer generally juxtaposed with the card turning device 10, the turning device 20 revolves 180° to turn out the card, and send it back to the printer.

However, when the card fed from the printer is defective, the rotary body 20 is turned 90° so that the defective card Cx is discharged into a rubbish box 56 in the direction W2.

In a case that the card to which information data are magnetically written in the magnetic encoder ME as shown in FIG. 2 is sent into the card turning device 10 in the direction W3, if magnetic writing is unsuccessful upon checking the card, the card may be discharged into the rubbish box 56 in the same manner as above.

Although the embodiment is illustrated as turning the rotary body 20 at 90° to discharge the defective card downward, the turning angle of the rotary body 20 is not specifically limited for sorting or selecting the cards to be dealt with.

Thus, the card turning device according to this invention can be widely applied to not only various card printers for identity cards or credit cards, but also a ticket vending machine, a card sorter and so on.

As is apparent from the foregoing description, the card turning device according to this invention has a function of rotating the rotary body to turn over the card fed from a printer without causing displacement of the card, and sending back the inverted card to the printer, thereby to perform printing on both sides of the card with high efficiency. Since the turning device of this invention is simple in structure and applicable to a card printer that enables printing on one side of the card, the card turning device of this invention can make a printing system including the printer and this card turning device inexpensive.

It is further understood by those skilled in the art that the foregoing description is a preferred embodiment of the disclosed device and that various changes and modifications may be made in the invention without departing from the spirit and scope thereof.

What is claimed is:

1. A card turning device for a card printer, comprising a rotary body rotatable on a turning axis, said rotary body including roller units with card feed rollers being in contact in pairs on a card feed passage transverse to said turning axis; a card feed means including a card feeding motor and an axial pulley disposed on said turning axis for transmitting rotational motion of said card feeding motor to at least one of said card feed rollers to move the card held between said card feed rollers; means for turning said rotary body; and a rotation switch means for selectively transmitting the rotation of said card feeding motor through said pulley to said at least one card feed roller.

2. A card turning device for turning over a card issued from a card printer, comprising:

a rotary body rotatable on a turning axis placed tranversely on a card feeding passage along which the card is forwarded, said rotary body including two roller units each having paired card feed rollers being in contact in pairs on said card feed passage, said roller units being supported symmetrically with respect to said turning axis;

a card feed means including a card feeding motor and at least one axial pulley disposed freely rotatably on said turning axis of said rotary body for transmitting rotational motion produced by said card feeding motor through said pulley to at least one of said card feed rollers to move the card held between said paired card feed rollers;

means for turning said rotary body on said turning axis; and a rotation switch means for transmitting the rotation in at least one direction from said card feeding motor to said at least one card feed roller, said card feed rollers being driven by said card feed means to move the card, and stopped by said rotation switch means when said rotary body revolves to turn over the card.

3. A card turning device according to claim 2, wherein said card feed means further includes a stationary-side transmission means for connecting said card feeding motor to said axial pulley, a feeding pulley secured on a rotation shaft on which at least one of said rollers is supported, said feeding pulley incorporating said rotation switch means, and a turning-side transmission means for connecting said axial pulley to said feeding pulley.

4. A card turning device according to claim 2, wherein said rotation switch means is a one-way clutch.

5. A card turning device according to claim 2, wherein said rotation switch means is an electromagnetic clutch.

6. A card turning device according to claim 2, wherein one of said paired card feed rollers in each roller unit is a drive roller driven by said card feed means, and the other card feed roller is an idle roller coming in press contact with said drive roller.

7. A card turning device according to claim 6, wherein said drive roller in one of said roller units is connected to said drive roller in the other roller unit through a rotation transmission system.

8. A card turning device according to claim 6, wherein both said drive rollers in said roller units are driven by said card feed means.

9. A card turning device according to claim 2, wherein said rotary body is formed of a frame, said frame rotatably supported on a support base, including a horizontal beam, said beam having side ends and being provided on its side ends with side walls, wherein said roller units are retained between said side walls, said support base being provided with a position sensor for detecting the rotary body assuming its horizontal posture.

10. A card turning device according to claim 9, wherein said position sensor is formed of marking tags protruding horizontally from one of said side walls and a photo interrupter for detecting one of said marking tags.

11. A card turning device according to claim 2, wherein said rotary body is provided with a card face detector for perceiving the card.

12. A card turning device according to claim 11, wherein said card face detector is formed of a semicircular index plate and an index sensor for detecting said index plate.

13. A card turning device according to claim 9, wherein said rotary body is provided with a card face detector for perceiving the card.

14. A card turning device according to claim 13, wherein said card face detector is formed of a semicircular index plate and an index sensor for detecting said index plate.

* * * * *